US009138626B1

(12) United States Patent
Messimer

(10) Patent No.: US 9,138,626 B1
(45) Date of Patent: Sep. 22, 2015

(54) PORTABLE, FOLDABLE, FOOTBALL THROWING GAME

(71) Applicant: Michael Messimer, Denver, CO (US)

(72) Inventor: Michael Messimer, Denver, CO (US)

( * ) Notice: Subject to any disclaimer, the term of this patent is extended or adjusted under 35 U.S.C. 154(b) by 0 days.

(21) Appl. No.: 14/046,931

(22) Filed: Oct. 5, 2013

(51) Int. Cl.
*A63B 63/00* (2006.01)

(52) U.S. Cl.
CPC ..... *A63B 63/00* (2013.01); *A63B 63/004* (2013.01)

(58) Field of Classification Search
CPC .. A63B 67/06; A63B 63/00; A63B 2063/001; A63B 63/004
USPC ..... 273/402, 400, 398, 399, 401, 410, 407
See application file for complete search history.

(56) References Cited

U.S. PATENT DOCUMENTS

| | | | | | |
|---|---|---|---|---|---|
| 715,249 | A * | 12/1902 | Dunbar | 273/401 |
| 1,763,671 | A * | 6/1930 | Rastetter | 108/127 |
| 5,042,770 | A * | 8/1991 | Louthan | 248/311.2 |
| 5,524,901 | A | 6/1996 | Bison et al. | |
| 6,688,239 | B1 * | 2/2004 | Pettini et al. | 108/50.11 |
| 6,736,738 | B1 | 5/2004 | Taa | |
| 7,288,033 | B1 | 10/2007 | Jordan | |
| 2006/0079351 | A1 | 4/2006 | Brenneke | |
| 2006/0081748 | A1 * | 4/2006 | Sherman et al. | 248/309.1 |
| 2007/0052178 | A1 | 3/2007 | Cottrell | |
| 2008/0111312 | A1 * | 5/2008 | Longo et al. | 273/402 |
| 2010/0081513 | A1 * | 4/2010 | La Pointe | 473/197 |
| 2011/0074111 | A1 * | 3/2011 | Jackson | 273/400 |

* cited by examiner

*Primary Examiner* — Gene Kim
*Assistant Examiner* — Rayshun K Peng
(74) *Attorney, Agent, or Firm* — Edwin H. Crabtree; Ramon L. Pizarro

(57) ABSTRACT

A football throwing game having a two-piece game board divided vertically in half and having a first side and a second side. The two sides are hinged together and folded when in a stored position and unfolded and set upright when playing the game. The game board includes a plurality of ball target openings having a diameter greater than a diameter of the football for receiving the football therethrough. A back of the game board can include a net for catching the football when received through one of the target openings. Also, the back of the game board includes two foldable legs for holding the game board upright and at an angle to the vertical.

1 Claim, 2 Drawing Sheets

PORTABLE, FOLDABLE, FOOTBALL THROWING GAME

BACKGROUND OF THE INVENTION (a) Field of the Invention

This invention relates to an outdoor or indoor ball throwing game played by one, two or more players and teams of players, and more particularly, but not by way of limitation, to a portable, foldable, football throwing game having a game board with a plurality of target holes therein. A point is scored by a player throwing the football from a certain distance through one of the target holes in the game board.

(b) Discussion of Prior Art

Heretofore, there have been a variety of target toss games and in particular for throwing a football. In U.S. Pat. No. 6,736,738 to Taa and U.S. Pat. No. 7,288,033 to Jordan, and U.S. Patent Publication 2006,0079351 to Brenneke, three different types of football target apparatus are disclosed for practicing and developing a skill of throwing a football. Also, U.S. Pat. No. 5,524,901 to Bison et al. and U.S. Patent Publication 2007/0052178 to Cottrell illustrate a sport target apparatus and an adjustable ring for throwing a ball at a target or throwing a flying disc throw a ring.

None of the above mentioned prior art references illustrate or describe the unique structure and function of the subject football throwing game as disclosed herein.

SUMMARY OF THE INVENTION

In view of the foregoing, it is a primary objective of the subject invention to provide an exciting and entertaining football throwing game, which can be played by players of all ages. The game can be quickly set up in a backyard, a parking lot before a football game or in a recreational area in a home.

Another object of the invention is the football game can be played by two or more players with a winner scoring the most points by throwing a football through target holes in a game board.

Yet another object of the invention is young and old football players can use the game to improve their throwing skills at different distances from the game board.

Still another object of the invention is the game board can be folded in half for ease in transporting and storing and then unfolded and quickly set up for playing.

The subject portable, foldable, football throwing game includes a two-piece game board divided vertically in half and having a first side and a second side. The first and second sides are hinged together and folded with in a stored position and unfolded and set upright when playing the game. The game board includes a top ball target opening, two middle ball target openings and three bottom ball target openings. The target openings have a diameter greater than a diameter of the football for receiving the ball therethrough. A back of the game board can include a net for catching the football when received through one of the target openings. Also, the back of the game board includes two foldable legs for holding the game board upright and at an angle to the vertical.

These and other objects of the present invention will become apparent to those familiar with different types and designs of ball throwing games and apparatus when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the football throwing game, and in which.

DETAILED DESCRIPTION OF THE PREFERRED EMBODIMENTS

Figure 1:
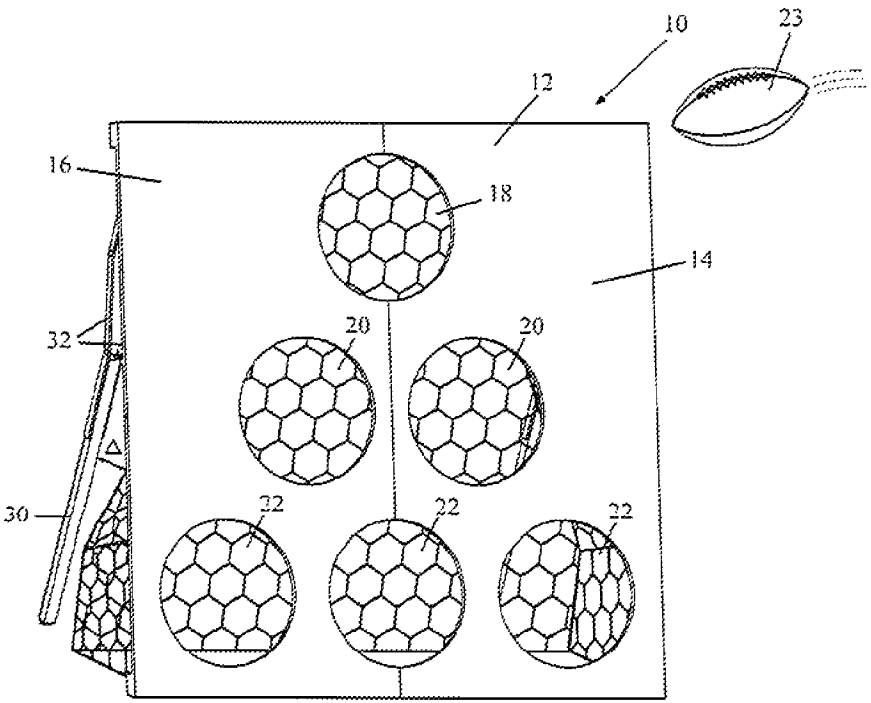
FIG. 1 is a front perspective view of the portable football throwing game with the two-piece game board set up and at an angle from the vertical. The game board is shown having a plurality of target holes for receiving the football therethrough.

In FIG. 1, a front perspective view of the subject portable, foldable, football throwing game is illustrated and having a general reference numeral 10. The game 10 includes a two-piece, game board 12, which is divided in half vertically and having a first side 14 and a second side 16. The game board 12 includes a top ball target opening 18, with one half of the opening 18 in the first side 14 and the other half in the second side 16. Also, the game board 12 includes two middle ball target openings 20 disposed below the target opening 18. One of the middle ball target openings 20 is in the first side 14 and an other middle ball target opening 20 is in the second side 16. Further, the game board 12 includes three bottom ball target openings 22 disposed below the target openings 20. A center target opening 22 of the bottom ball target openings 22 has one half of the opening the first side 14 and the other half in the second side 16. Also, one of the bottom ball target openings 22 is in the first side 14 and an other bottom ball target opening 22 is in the second side 16.

In this drawing, a football 23 is shown approaching a front of the game board 12 and possibly received through one of the target holes. For example and in scoring the game, the football 23 received through the top ball target opening might score 3 points, and through the middle ball target openings 2 points, and through the bottom ball target openings 22 three points. Obviously, various combinations of a point scoring system can be used with the subject invention. Also, the target openings have a diameter greater than the diameter of the football for receiving the football through one of the openings. Further, while a football is discussed herein, other different shapes and sizes of playing balls can be used equally well when playing the game 10 using the game board 12.

Figure 2:
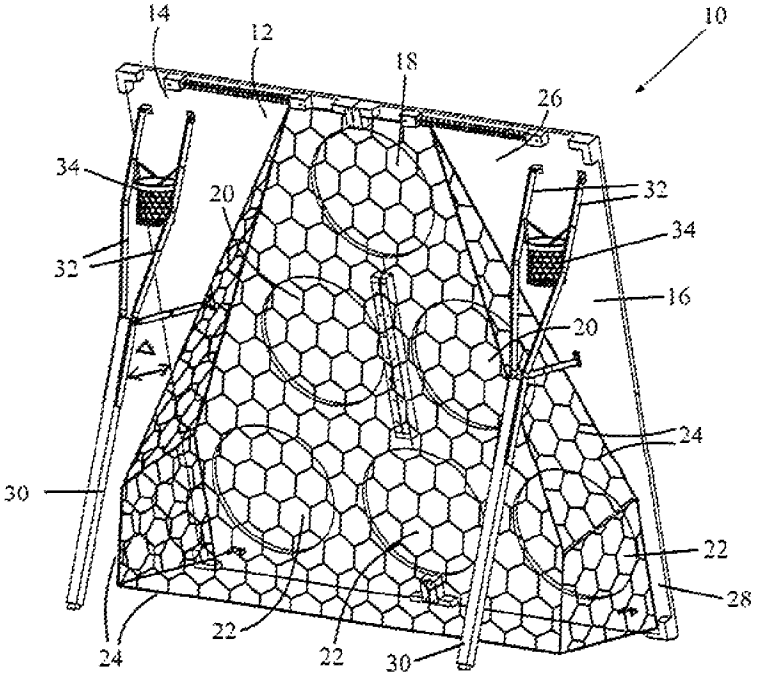
FIG. 2 is a rear perspective view of the game board and illustrating a net attached to a back of the board for catching a football received through one of the target holes. Also, a pair of foldable legs are shown attached to a top portion of the board for holding it in an upright position.

In FIG. 2, a rear perspective view of the throwing game 10 is shown with a triangular-shaped net 24 attached to a top portion 26, a bottom portion 28 and opposite sides of the back of the board 12. The net 24 surrounds the back of the target openings 18, 20 and 22 for catching the football 23, shown in FIG. 1, as it approaches a front of the game board 12 and passes through one of the openings.

In this drawing, the game board 12 is shown with a pair of foldable legs 30 having forked ends 32 hinged to the top portion 26 of the first side 14 and second side 16 of the back of the board 12. The foldable legs 30 hold the game board 12 upright and at an angle "Δ" of 60 to 90 degrees from the horizontal. Disposed between the forked ends 32 and attached thereto are drink holders 34 for holding a drink during the play of the game 10. The drink holders 34 can also be attached at other locations on the back of the game board 12.

Figure 3:
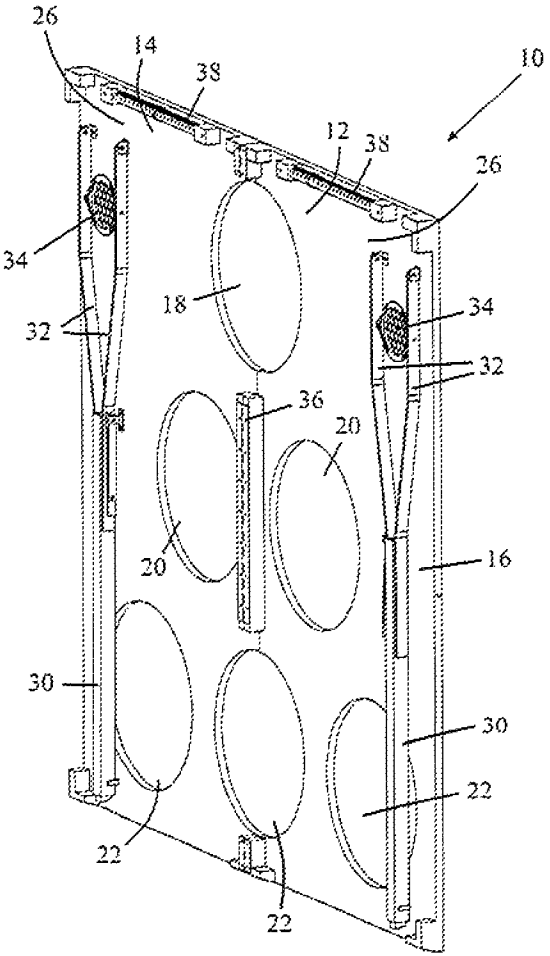
FIG. 3 is another perspective view of the rear of the game board and showing the legs folded against the back of the board.

In FIG. 3, another perspective view of the rear of the game board 12 is shown with the legs 30 folded upwardly and against the back of the board 12. In this drawing, the first side 14 of the board 12 is shown hinged to the second side 16 using a hinge 36. Also seen in this drawing are a pair of scoring racks 38 mounted on the top portion 26 of the first side 14 and second side 16 of the board 12. The scoring racks 38 can be used for keeping score for individual players or for player teams.

Figure 4:
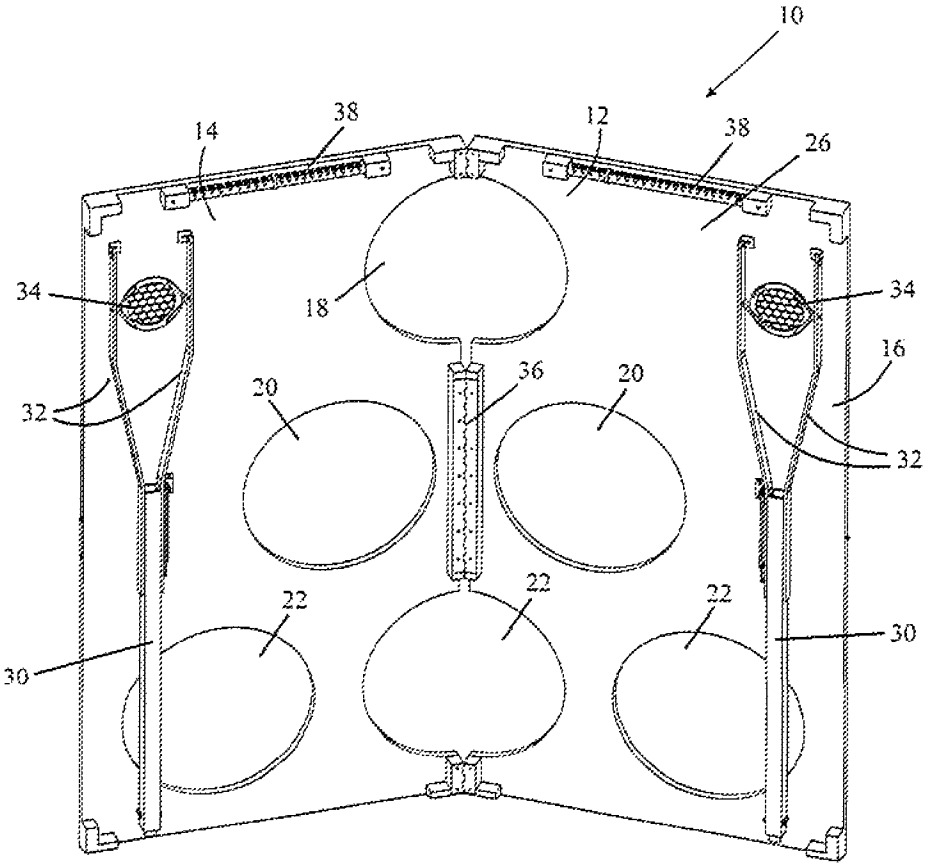
FIG. 4 is still another perspective view of the rear of the game board and partially folded and ready for a first side of the board to be folded against a second side of the board for ease in transporting and storing the game.

In FIG. 4, still another perspective view of the rear of the game board 12 is shown with the first side 14 partially folded toward the second side 16 using the hinge 36. By continuing the fold the first and second sides 14 and 16 next to each other, the game board 12 can then be easily transported in a vehicle or moved to a storage area.

While only one of the football throwing games 10 is shown in the drawings, it can be appreciated that two of the games 10 can be placed facing each other at a distance of 10 to 20 feet or more, depending on the skill level and ages of the players. In this manner, one or more footballs 23 can be thrown by one team at ball targets in a first game board and a second team can throw footballs in the opposite directions at ball targets in a second game board.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The invention claimed is:

1. A football throwing game using a football, the game comprising:

a two-piece game board, the game board divided vertically in half and having a first side, a second side, a front side and a back side, the football throwing game comprising:

a top ball target opening in the game board, one half of the top ball target opening is disposed in the first side of the board and one half of the top ball target opening is disposed in the second side of the board;

two middle ball target openings in the game board and disposed below the top ball target opening, one of the middle ball target openings disposed in the first side of the board and the other middle ball target opening disposed in the second side of the board;

three bottom ball target openings and disposed below the middle ball target openings, one of the bottom ball target openings disposed in the first side of the board, one of the bottom ball target openings disposed in the second side of the board, and one half of one on the bottom ball target openings disposed in the first side of the board and the other half of the bottom ball target opening disposed in the second side of the board, the target openings having a diameter greater than a diameter of the football for receiving the football therethrough;

a pair of foldable legs attached to a back of the game board for holding the game board upright when playing the game, the foldable legs disposed at an angle "Δ" of 60 to 90 degrees from the horizontal for holding the game in an upright position, the foldable legs including forked ends with drink holder attached between the forked ends and rotatable thereon;

a triangular-shaped net, the net attached to the back of the game board and disposed behind and around the target openings, the net used for catching the football when the football is received through one of the target openings; and a hinge mounted on the back side of the first and second sides of the game board and disposed between the middle ball target openings, the hinge allowing the back side of the first side of the game board to be folded on top of the back side of the second side of the game board for ease in transporting the game board and a pair of scoring racks attached to a top portion of the back of the game board, the scoring racks used by players or teams for keeping track of their scores.

* * * * *